US007007499B1

(12) United States Patent
Patel

(10) Patent No.: US 7,007,499 B1
(45) Date of Patent: Mar. 7, 2006

(54) CONDENSER ASSEMBLY HAVING A MOUNTING RIB

(75) Inventor: Ramchandra L. Patel, Southgate, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 1 day.

(21) Appl. No.: 10/932,865

(22) Filed: Sep. 2, 2004

(51) Int. Cl.
*F25B 39/04* (2006.01)

(52) U.S. Cl. ..... 62/298; 62/507; 62/509

(58) Field of Classification Search ..... 62/298, 62/474, 507, 509; 165/876
See application file for complete search history.

(56) References Cited

U.S. PATENT DOCUMENTS

| | | | | |
|---|---|---|---|---|
| 3,858,647 | A | 1/1975 | Hickman et al. | |
| 4,418,746 | A | 12/1983 | Langenhorst et al. | |
| 5,062,476 | A | 11/1991 | Ryan et al. | |
| 5,152,339 | A | 10/1992 | Calleson | |
| 5,186,246 | A | 2/1993 | Halstead | |
| 5,226,490 | A | 7/1993 | Ryan et al. | |
| 5,236,044 | A | 8/1993 | Nagasaka et al. | |
| 5,297,624 | A | 3/1994 | Haussmann et al. | |
| 5,307,870 | A | 5/1994 | Kamiya et al. | |
| 5,320,165 | A | 6/1994 | Hughes | |
| 5,419,141 | A | 5/1995 | Burk | |
| 5,537,839 | A | 7/1996 | Burk et al. | |
| 5,546,761 | A | 8/1996 | Matsuo et al. | |
| 5,582,027 | A | 12/1996 | Baba et al. | |
| 5,592,830 | A | 1/1997 | Baba et al. | |
| 5,628,206 | A | 5/1997 | Baba | |
| 5,713,217 | A | 2/1998 | Baba | |
| 5,727,626 | A | 3/1998 | Kato | |
| 5,813,249 | A | 9/1998 | Matsuo et al. | |
| 5,816,321 | A | 10/1998 | Wijkstrom | |
| 5,875,650 | A | 3/1999 | Nobuta et al. | |
| 5,901,573 | A * | 5/1999 | Kobayashi | 62/507 |
| 5,946,940 | A | 9/1999 | Inoue | |
| 6,115,918 | A | 9/2000 | Kent | |
| 6,223,556 | B1 | 5/2001 | De Keuster et al. | |
| 6,341,647 | B1 | 1/2002 | Nobuta et al. | |
| 6,374,632 | B1 | 4/2002 | Nobuta et al. | |
| 6,397,627 | B1 | 6/2002 | Aki et al. | |
| 6,397,937 | B1 | 6/2002 | Ghiani | |
| 6,622,517 | B1 | 9/2003 | Whitlow et al. | |
| 6,629,560 | B1 | 10/2003 | Kaspar et al. | |
| 6,694,773 | B1 | 2/2004 | Snow et al. | |
| 6,725,913 | B1 | 4/2004 | Memory et al. | |

* cited by examiner

*Primary Examiner*—William E. Tapolcai
(74) *Attorney, Agent, or Firm*—Brinks Hofer Gilson & Lione

(57) ABSTRACT

A condenser assembly for a vehicle air conditioning system is provided. The condenser assembly includes a core including first and second ends and a plurality of tubes extending therebetween, a first header located adjacent to the first end of the core, and a second header located adjacent to the second end of the core. The second header includes a receiver/dryer having a receiver/dryer chamber, a manifold cooperating with the receiver/dryer to define a manifold chamber, and a mounting rib unitarily formed with at least one of the receiver/dryer and the manifold. The mounting rib includes a first portion extending away from the at least one of the receiver/dryer and the manifold in a first direction and a second portion extending away from the first portion in a second direction that is substantially nonparallel with the first direction.

12 Claims, 3 Drawing Sheets

CONDENSER ASSEMBLY HAVING A MOUNTING RIB

BACKGROUND

1. Field of the Invention

The present invention relates generally to air conditioning systems for motor vehicles and, more specifically, to a condenser with an integral receiver/dryer for an air conditioning system in a motor vehicle and a method of assembling the condenser.

2. Related Technology

Condenser assemblies for automotive vehicle air conditioning systems typically include a pair of headers and a core having a plurality of tubes, through which refrigerant flows, disposed horizontally between the two headers. An inlet is disposed near an upper portion of one of the headers and an outlet is disposed at the lower portion of either the same or the other header. Within the headers, partitions may be provided to divide the interior space of the headers into more than one fluidly separate spaces. As a result, the refrigerant is caused to flow in a serpentine fashion making more than one path through the tubes between the headers.

Typically attached to one of the headers and in fluid communication therewith is a receiver. Refrigerant condensed in the core flows into the receiver where it is separated into gas and liquid portions. Because the presence of water in the refrigerant will degrade the performance and structural integrity of the air conditioning system, a dryer is often associated with or located within the receiver. The dryer is located within the receiver so that the dryer is in contact with the liquid portion of the refrigerant facilitating the removal of water from the refrigerant. The dryer may itself be comprised of a bag or cartridge containing dryer granulates such as desiccant.

More recent designs of condenser assemblies have integrated the receiver/dryer with one of the headers mentioned above. One process of doing this has been to locate a plate within the header so as to divide the header into a manifold portion and a receiver/dryer portion. One drawback of this construction is that the design requires, for structural integrity of the system, a center line alignment of the core and the header containing the integrated receiver/dryer. Another drawback of this construction is that the joint between the manifold portion and the receiver/dryer portion cannot be inspected after brazing from the outside of the header.

Therefore, it may be desirable to provide a receiver/dryer structure, to provide a manifold structure, and then connect the respective structures. The manifold and the receiver/dryer are typically connected via a brazing method. More specifically, the manifold is positioned in desired location with respect to the receiver/dryer such that a portion of the manifold engages a portion of the receiver/dryer. The respective engaging portions are fixedly connected via a brazing method, such as a brazing oven. However, the manifold and the receiver/dryer may become partially or completely disengaged from each other before or during the brazing process, leading to an insufficient or an incomplete connection between the respective components.

Therefore, it is desirable to provide an assembly and a method of assembly in order to sufficiently engage the manifold and the receiver/dryer.

SUMMARY

In one configuration of the present invention, a condenser assembly for a vehicle air conditioning system is provided, comprising: a core including first and second ends and a plurality of tubes extending therebetween, a first header located adjacent to the first end of the core, and a second header located adjacent to the second end of the core. The second header includes a receiver/dryer having a receiver/dryer chamber, a manifold cooperating with the receiver/dryer to define a manifold chamber being in fluid communication with the flow passages in the tubes, and a mounting rib unitarily formed with at least one of the receiver/dryer and the manifold. The mounting rib includes a first portion extending away from the at least one of the receiver/dryer and the manifold in a first direction and a second portion extending away from the first portion in a second direction that is substantially nonparallel with the first direction.

In another configuration, the first direction and the second direction cooperate to define an angle being greater than 45° and being less than 135°. The first direction and the second direction may be generally perpendicular with each other.

In yet another configuration, the mounting rib further includes a weakened line connecting the first portion and the second portion. The weakened line may be an arcuate groove.

In another configuration, the receiver/dryer includes a top end and a bottom end, and the mounting rib extends substantially continuously from the top end to the bottom end in a direction generally perpendicularly to the plurality of tubes.

In yet another configuration, the condenser assembly further comprises a second mounting rib unitarily formed with the at least one of the receiver/dryer and the manifold. The mounting rib and the second mounting rib and the second mounting rib are each unitarily formed with the receiver/dryer. Additionally, the manifold includes a flange and a second flange, the mounting rib engages the flange of the manifold, and the second mounting rib engages the second flange of the manifold. The mounting rib is a deformable mounting rib and the second mounting rib is a fixed mounting rib.

In another configuration, the condenser assembly further comprises a third mounting rib and a fourth mounting rib, each unitarily formed with the receiver/dryer. The third mounting rib and the fourth mounting rib engage a mounting bracket coupled to the vehicle. The third mounting rib is a deformable mounting rib and the fourth mounting rib is a fixed mounting rib.

The first header is connected to the core such that the first header is in fluid communication with the tubes in the core. Furthermore, the manifold is connected to the core such that the manifold chamber and the receiver/dryer chamber are in fluid communication with the tubes. A mounting rib is formed on at least one of the receiver/dryer and the manifold for coupling the manifold and the receiver/dryer with each other. The mounting rib may be brazed in order to further connect the manifold and the receiver/dryer with each other.

DETAILED DESCRIPTION

Figure 1:
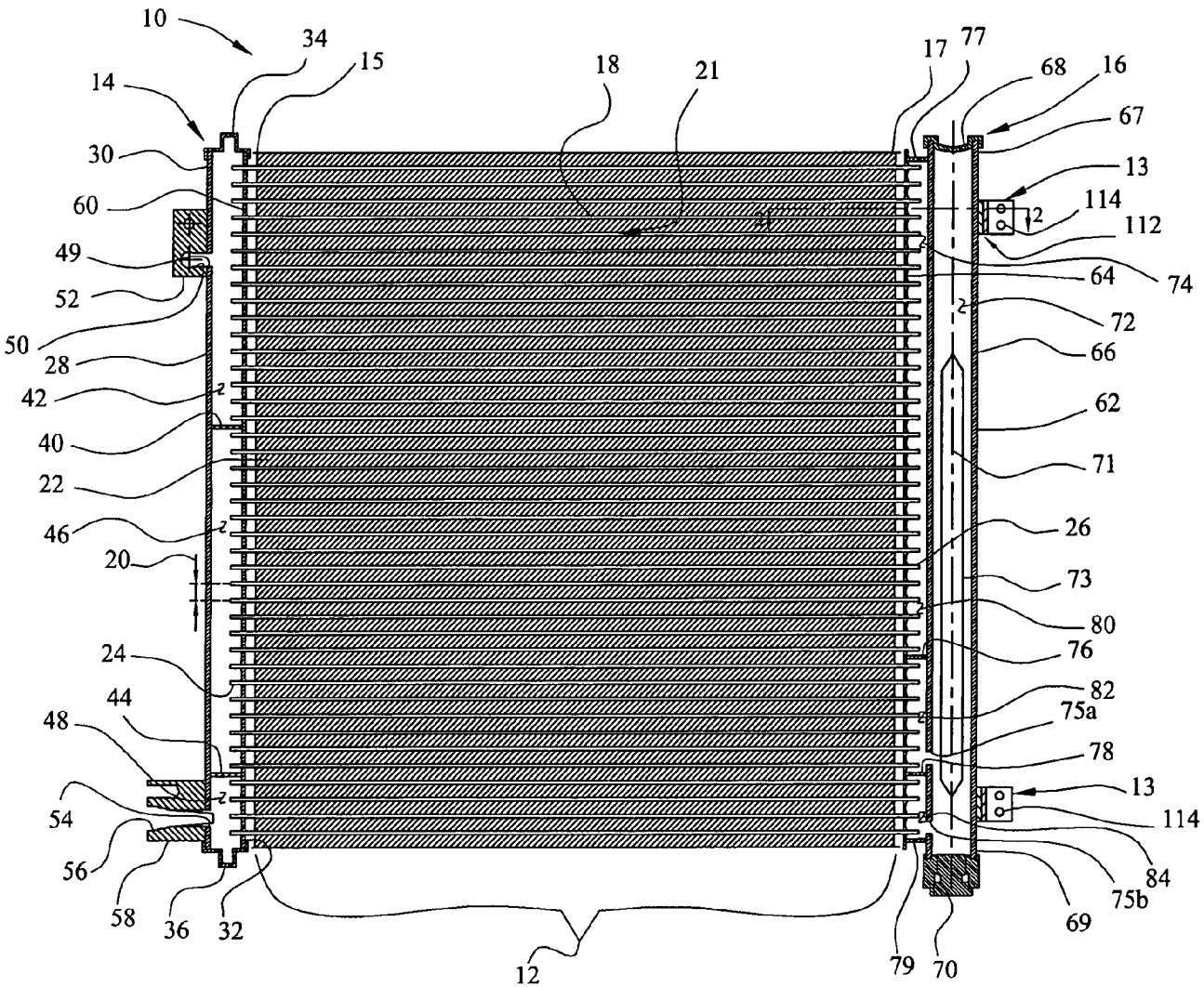
FIG. 1 shows a condenser having a manifold and a pair of mounting brackets coupled with a receiver/dryer and embodying the principles of the present invention.

Referring now to the drawings, FIG. 1 shows a condenser assembly 10 embodying the principals of the present invention. The condenser assembly 10 includes a core 12, a first header 14, and a second header 16. The headers 14 and 16 are located at opposing ends of the core 12, as further mentioned below. The condenser 10 further includes a pair of brackets 13 in order to mount the condenser 10 to a mounting portion of the vehicle (not shown) during use in an air conditioning system (not shown).

The core 12 is a tube stack comprising a series of tubes 18 extending between the headers 14, 16. More specifically, a first end 15 of the core 12 extends into the first header 14 and a second end 17 of the core 12 extends into the second header 16. The tubes 18 are generally parallel to each other and are vertically stacked with respect to each other. Adjacent tubes 18 are generally evenly-spaced apart from one another such that a space 20 is located therebetween. The tubes 18 themselves may be of any appropriate construction. In one preferred embodiment, the tubes are generally flat and include portions defining one or more flow channels 21 longitudinally through the tube.

Located within the space 20 between each adjacent tube 18 is a fin 22 for increasing heat transfer between the tubes 18 and an airflow intersecting the condenser assembly 10. The fins 22 exhibit a generally corrugated shape comprising a series of convolutes as is commonly known in the industry. The fins 22 generally extend completely across the space 20 contacting both the tube located thereabove and therebelow. In the figures, the details of the shape of the fins 22 are not illustrated in significant detail since those skilled in this technology will readily appreciate such a construction. Additionally, the fins 22 are preferably provided with a series of louvers on each corrugation in order to aid in the heat transfer efficiency from the tubes, to the fins and to the air passing therethrough. The fins 22 are provided in such a manner that the overall length of the tubes 18 is greater than the overall length of the fins 22 and that the ends 24 and 26 of the tubes 18 extend beyond the end of the fins 22. These first and second ends 24, 26 of the tubes are respectively received within the first and second headers 14, 16 and, as further discussed below, are in fluid communication with the first and second headers 14, 16.

The first header 14 (hereinafter the "inlet/outlet header" or "I/O header") is shown on the left-hand side of FIG. 1. The I/O header 14 is preferably constructed of a cylindrical body or member 28 that has a constant cross-sectional profile, round in the preferred embodiment, over its length. The top and bottom ends 30, 32 of the cylindrical body 28 are respectively engaged and closed by top and bottom caps 34, 36. A partition or baffle 40 is preferably located within the cylindrical body 28 so as to cooperate with the cylindrical body and the upper cap 34 in order to define an upper chamber 42, which will be discussed in more detail below. Furthermore, an additional partition 44 may be provided to define a middle chamber 46 and a lower chamber 48. The lower chamber 48, as will be discussed in more detail below, is often referred to as the super-cooled region.

The I/O header 14 includes an inlet aperture 49 that communicates with an inlet bore 50 defined in an inlet block 52. Similarly, the I/O header 14 includes an outlet aperture 54 that is in communication with an outlet bore 56 defined in an outlet block 58 mounted to the cylindrical body 28 of the I/O header 14.

During operation of the air conditioner, refrigerant enters into the condenser assembly 10 via the inlet block 52 and exits from the condenser assembly 10 via the outlet block 58. In order for the cavity 38 of the I/O header 14 to fluidly communicate with the tubes 18, the end 24 of each tube 18 is received through a tube aperture 60 defined in one side of the cylindrical body 28.

The remaining header 16 of the condenser assembly 10 is generally illustrated on the right hand side of FIG. 1. This header 16 is hereinafter referred to as the "receiver/dryer header" or "R/D header". The R/D header 16 is preferably an integrated structure made up of two components, a receiver/dryer 62 and a manifold 64, which will now be discussed in more detail.

The receiver/dryer 62 preferably includes a cylindrical body or member 66 having top and bottom ends 67, 69 respectively closed by top and bottom caps 68, 70. Therefore, the top and bottom caps 68, 70 cooperate with the cylindrical body 66 to define a R/D chamber 72 within the R/D header 16. The cylindrical body 66 preferably exhibits a substantially constant cross-sectional profile along its length. More preferably, the cylindrical body 66 includes a generally round cross-sectional profile along its length having a longitudinal axis 71 shown in FIG. 1.

The R/D chamber 72 is in fluid connection with the manifold chamber 74 via a first opening 75*a* and a second opening 75*b* in the receiver/dryer 62. The R/D chamber 72 preferably includes a drying element, such as a dryer 73. The dryer 73 shown in FIG. 1 comprises a dryer bag containing a liquid-absorbing component, such as desiccant material. Any water in the refrigerant is absorbed by the dryer 73 in order to improve the performance and structural integrity of the air conditioning system.

The manifold 64 and the cylindrical body 66 cooperate to define a manifold chamber 74. The second header 16 preferably includes at least one partition and at least two caps in order to divide the manifold chamber 74 into a plurality of chambers. As shown in FIG. 1, an upper partition 76, a lower partition 78, a top cap 77, and a bottom cap 79 are located within the manifold chamber 74 in order to form respective substantially fluid-tight seals with the manifold 64 and the receiver dryer 62. More specifically, the upper partition 76 cooperates with the manifold 64, the receiver dryer 62, and the top cap 77 in order to define an upper chamber 80. Similarly, the upper partition 76 cooperates with the manifold 64, the receiver dryer 62, and the lower partition 78 in order to define a middle chamber 82 and the lower partition 78 cooperates with the manifold 64, the receiver dryer 62, and the bottom cap 79 in order to define a lower chamber 84.

In order to form a substantially fluid-tight seal between the manifold 64 and the receiver/dryer 62, the respective components 62, 64 are preferably brazed together by being exposed to relatively high temperatures as is known in the art. As discussed above, it is advantageous for respective components to be engaged with each other during the brazing process in order to form a robust connection. Therefore, it may be advantageous to provide engaging component(s) to engage the manifold 64 and the receiver/dryer 62 with each other before and during the brazing process. Similarly, the engaging components may be used as an alternative to the brazing process.

Figure 2:
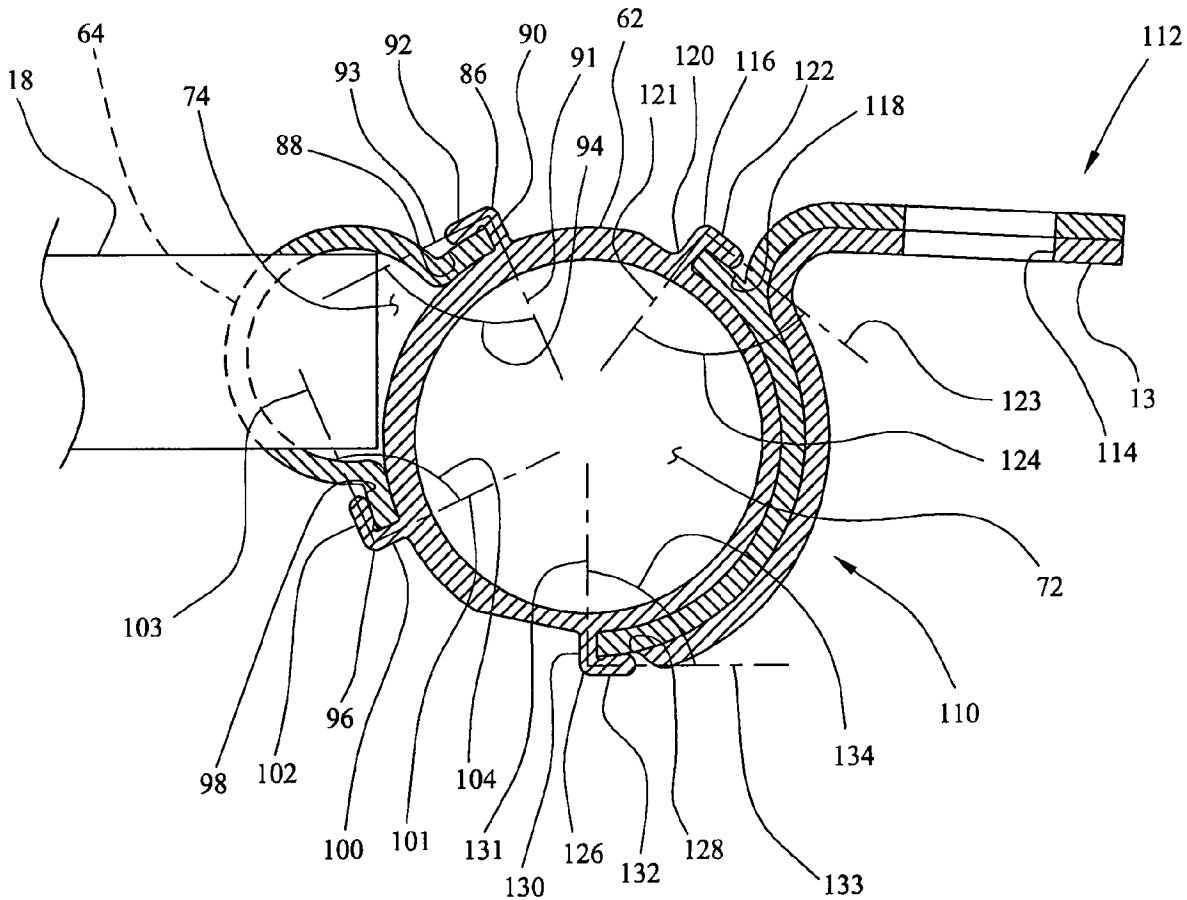
FIG. 2 is a cross-sectional view of the condenser taken along line 2—2 in FIG. 1, showing the manifold, the receiver/dryer, and one of the mounting brackets being coupled by deformable mounting ribs and a fixed mounting rib.

Referring now to FIG. 2, a first mounting rib 86 is provided in order to engage the manifold 64 and the receiver/dryer 62 with each other. The mounting rib 86 in FIG. 2 is unitarily formed with the receiver/dryer 62 and engages a flange 88 of the manifold 64. However, the mounting rib 86 may alternatively be formed with the manifold 64 in order to engage a flange of the receiver/dryer 62. The flange 88 preferably extends along and parallel to the outer surface of the receiver/dryer 62 in order to increase the contact surface area between the respective components 62, 64.

The mounting rib 86 preferably includes a first portion 90 extending away from the receiver/dryer 62 in a first direction 91 and a second portion 92 extending obliquely away from the first portion in a second direction 93. More specifically, the first direction 91 and the second direction 93 form an angle 94 that is preferably greater than 45° and less than 135°. More preferably, the first direction 91 and the second direction 93 are generally perpendicular to each other such that the first portion 90 and the second portion 92 each engage a respective portion of the flange 88. However, any appropriate angles may be formed by the first and second portions 90, 92.

A second mounting rib 96, similar to the first mounting rib 86, is provided in order to further engage the manifold 64 and the receiver/dryer 62 with each other. The second mounting rib 96 is unitarily formed with the receiver/dryer 62 in order to engage a second flange 98 of the manifold 64. The second flange 98 preferably extends along the receiver/dryer 62 similarly to the first flange 88. The second mounting rib 96 includes a first portion 100 extending away from the receiver/dryer 62 in a first direction 101 and a second portion 102 extending away from the first portion in a second direction 103 at an angle 104 that is preferably greater than 45° and less than 135°. More preferably, the first direction 101 and the second direction 103 are generally perpendicular to each other.

The mounting ribs 86, 96 preferably extend continuously from the top end 67 to the bottom end 69 of the receiver/dryer 62, but other configurations may be used. In particular, the mounting ribs 86, 96 may extend along a portion of the length of the receiver/dryer 62. Additionally, a plurality of first mounting ribs 86 may be longitudinally separated from each other and a plurality of second mounting ribs 96 may be similarly longitudinally separated from each other.

The first and second mounting ribs 86, 96 may be deformable mounting ribs, fixed mounting ribs, or a combination thereof. Deformable mounting ribs are defined as mounting ribs that are designed to be bent along a line in order to engage the respective manifold flanges 88, 98. In order to improve the accuracy of the line along which the deformable mounting rib(s) are bent, the first and/or second mounting ribs 86, 96 may include a weakened line extending along the length of the mounting ribs 86, 96. The weakened line is preferably located between the first portion 90, 100 and the second portion 92, 102 of the respective mounting ribs 86, 96 such that the first portion 90, 100 and the second portion 92, 102 each engage respective portions of the flanges 88, 98.

Figure 3:
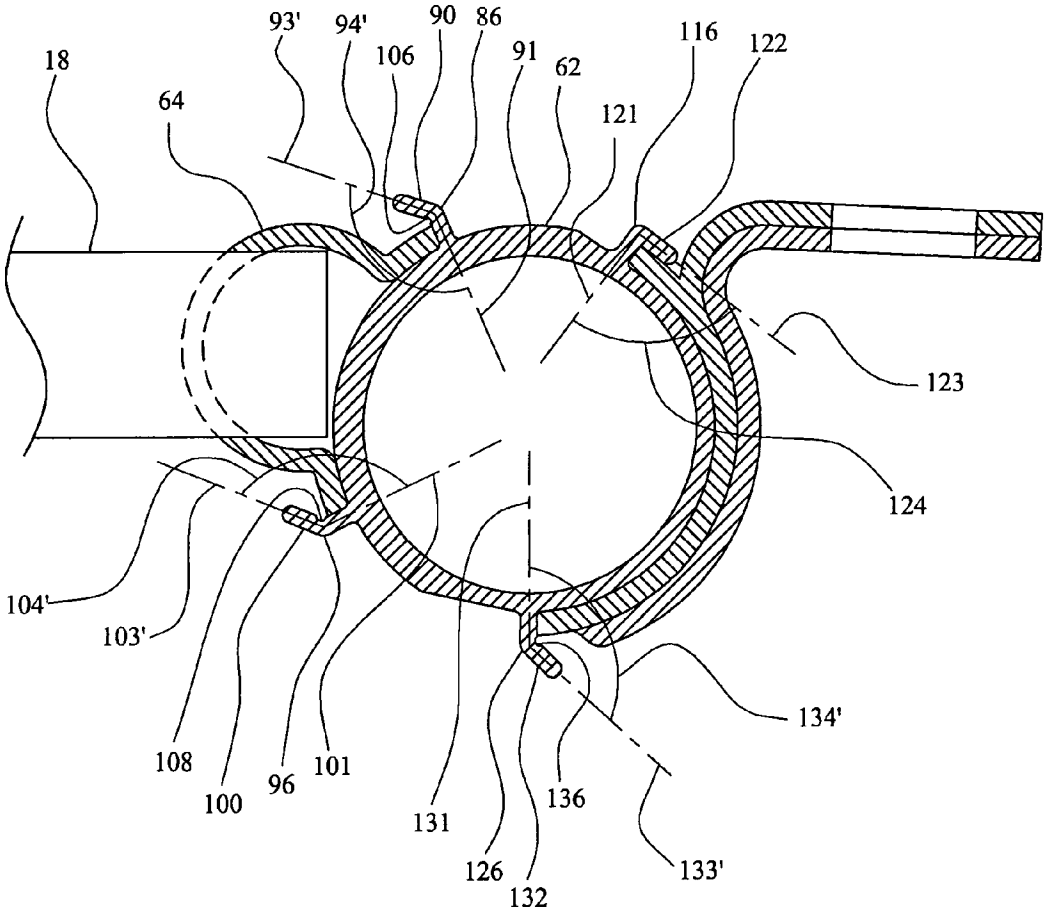
FIG. 3 is a cross-sectional view taken along line 2—2 in FIG. 1, showing the deformable ribs in an undeformed state.

Referring now to FIG. 3, the first mounting rib 86 and the second mounting rib 96 are each shown in an undeformed position, such that the respective second portions 92, 102 are not engaged with the flanges 88, 98 when the mounting ribs 86, 96 are undeformed. More specifically, the first direction 91, 101 of each of the first portions 90, 100 remains the same as shown in FIG. 2, but the second portions 92, 102 extend from the first portions 90, 100 at respective second directions 93', 103' that are preferably not the same as the second directions 93, 103 shown in FIG. 2. The first directions 91, 101 and the second directions 93', 103' in FIG. 3 form respective angles 94', 104' that are preferably greater than the angles 94, 104 shown in FIG. 2. Thus, the angles 94', 104' of the first and second mounting ribs 86, 96 shown in FIG. 3 permit the manifold 64 to be easily inserted between the respective mounting ribs 86, 96.

Also shown in FIG. 3, the weakened portion of each mounting rib 86, 96 is a groove 106, 108 having a thickness less than that of the respective first portions 90, 100 and second portions 92, 102. The reduced thickness of the grooves 106, 108 cause the mounting ribs 86, 96 to have a tendency to bend along the grooves 106, 108. The grooves 106, 108 preferably have an arcuate shape in order to simplify manufacturing.

Alternatively to the first and second mounting ribs 86, 96 shown in FIG. 3, at least one fixed mounting rib may be used instead of a deformable mounting rib. However, in order to simplify the connection between the manifold 64 and the receiver/dryer 62, at least one of the first and second mounting ribs 86, 96 is preferably a deformable mounting rib.

Referring back to FIG. 2, the connection between the receiver/dryer 62 and the bracket 13 will now be discussed. The bracket 13 includes a first portion 110 to be connected to the receiver/dryer 62 and a second portion 112 to be connected to a mounting portion of the vehicle. The first portion 110 of the bracket 13 preferably includes a pair of flanges 118, 128 which will be discussed in further detail below. The second portion 112 of the bracket 13 preferably includes at least one mounting hole 114 in order to receive a fastener or other appropriate connection means. As shown in FIG. 1, the condenser assembly 10 may include a pair of mounting brackets 13.

In order to engage the bracket 13 with the receiver/dryer 62, a third mounting rib 116 is provided in order to engage the bracket 13 and the receiver/dryer 62 with each other. The third mounting rib 116 in FIG. 2 is unitarily formed with the receiver/dryer 62 and engages the flange 118 of the bracket 13. However, the third mounting rib 116 may alternatively be formed with the bracket 13 in order to engage a flange of the receiver/dryer 62. The flange 118 preferably extends along and parallel to the outer surface of the receiver/dryer 62 in order to increase the contact surface area between the respective components 13, 62.

The mounting rib 86 preferably includes a first portion 120 extending away from the receiver/dryer 62 in a first direction 121 and a second portion 122 extending away from the first portion in a second direction 123 that is nonparallel with the first direction 121. More specifically, the first direction 121 and the second direction 123 form an angle 124 that is preferably greater than 45° and less than 135°. More preferably, the first direction 121 and the second direction 123 are generally perpendicular to each other such that the first portion 120 and the second portion 122 each engage a respective portion of the flange 118. However, any appropriate angles may be formed by the first and second portions 120, 122.

A fourth mounting rib 126 is also preferably provided in order to further engage the bracket 13 and the receiver/dryer 62 with each other. The fourth mounting rib 126 is unitarily formed with the receiver/dryer 62 in order to engage the second flange 128 of the bracket 13. The second flange 128 preferably extends along the receiver/dryer 62 similarly to the first flange 118. The fourth mounting rib 126 includes a first portion 130 extending away from the receiver/dryer 62 in a first direction 131 and a second portion 132 extending away from the first portion in a second direction 133 at an angle 134 that is preferably greater than 45° and less than 135°. More preferably, the first direction 131 and the second direction 133 are generally perpendicular to each other.

The third and fourth mounting ribs 116, 126 preferably extend continuously from the top end 67 to the bottom end 69 of the receiver/dryer 62, but other configurations may be used. In particular, the third and fourth mounting ribs 116, 126 may extend along a portion of the length of the receiver/dryer 62. Additionally, a plurality of third mounting ribs 116 may be longitudinally separated from each other and a plurality of fourth mounting ribs 126 may be similarly longitudinally separated from each other.

The third and fourth mounting ribs 116, 126 may be deformable mounting ribs, fixed mounting ribs, or a combination thereof. Similarly to the first and second mounting ribs 86, 96 described above, the third and fourth mounting ribs 116, 126 may include a weakened line extending along the length of the mounting ribs 116, 126. The weakened line is preferably located between the first portion 120, 130 and the second portion 122, 132 of the respective mounting ribs 116, 126.

Referring now to FIG. 3, the fourth mounting rib 126 is shown in an undeformed position, such that the second portion 132 is not engaged with the flange 128 when the fourth mounting rib 126 is undeformed. More specifically, the first direction 131 of the first portion 130 remains the same as shown in FIG. 2, but the second portion 132 extends from the first portions 130 at a second direction 133' that is preferably not the same as the second direction 133 shown in FIG. 2. The first direction 131 and the second direction 133' in FIG. 3 form an angle 134' that is preferably greater than the angle 134 shown in FIG. 2.

Also shown in FIG. 3, the weakened portion of the fourth mounting rib 126 is a groove 136 having a thickness less than that of the first portion 130 and second portion 132. The reduced thickness of the groove 136 causes the fourth mounting rib 126 to have a tendency to bend along the groove 136. The groove 136 preferably has an arcuate shape in order to simplify manufacturing.

The third mounting rib 116 shown in FIGS. 2 and 3 is a fixed mounting rib that is preferably pre-formed to have the angle 124. Therefore, the third mounting rib 116 is shown as having the same angle 124 in both FIGS. 2 and 3. The third mounting rib 116 may be or may not include a weakened line in order to cause the bent portion of the third mounting rib 116 to be precisely-located.

Alternatively to the third and fourth mounting ribs 116, 126 shown in FIG. 3, both of the third and fourth mounting ribs 116, 126 may be deformable ribs or may be fixed ribs. However, in order to simplify the connection between the bracket 13 and the receiver/dryer 62, at least one of the third and fourth mounting ribs 126, 136 is preferably a deformable mounting rib.

During operation of the condenser assembly 10, the refrigerant flows into the upper chamber 42 of the first header 14 via the inlet block 52 as described above. The refrigerant is typically substantially gaseous when it flows through the inlet block 52. Next, the refrigerant flows through the tubes 18, undergoing heat exchange with cross-flowing air, which promotes condensation of the refrigerant. The refrigerant then exits the tubes into the upper chamber 80 of the manifold 64. The refrigerant then flows back across the tubes 18, undergoing further heat exchange, and exits into the middle chamber 46 of the first header 14. The refrigerant makes yet another pass across the core 12 and into the middle chamber 82 of the manifold 64.

From the middle chamber 82, the refrigerant enters the R/D chamber 72 via the first opening 75*a*. The refrigerant is typically a 3-part fluid at this point in the system: gaseous refrigerant, liquid refrigerant, and water. The gaseous refrigerant rises to the top portion of the RID chamber 72 in order to undergo further condensation. The liquid refrigerant enters the lower chamber 84 of the manifold 64 via the second opening 75*b* and flows into the tubes 18, where it exits the condenser 10 via the outlet block 58 as described above. The water is preferably substantially absorbed by the dryer in order to minimize the amount of water degradating the performance of the refrigerant.

A method of assembling the manifold 64 and the receiver/dryer 62 will now be discussed. The manifold 64 is engaged with the receiver/dryer 62 such that the flanges 88, 98 engage the outer surface of the receiver/dryer 62 as shown in FIG. 3. The deformable ribs 86, 96 are then bent towards the flanges 88, 98 in order to form an engagement therewith.

Additionally, the bracket 13 is engaged with the receiver/dryer 62 such that the flanges 118, 128 engage the outer surface of the receiver/dryer 62 as shown in FIG. 3. More specifically, the first flange 118 is preferably first inserted into the third mounting rib 116 such that the first portion 120 and the second portion 122 of the third mounting rib 116 each engage a portion of the first flange 118 of the bracket 13.

Next, the second flange 128 of the bracket 13 is moved such as to engage first portion 130 of the fourth mounting rib 126 and the outer surface of the receiver/dryer 62, as shown in FIG. 3. Then, the second portion 132 of the fourth mounting rib 126 is deformed in order to engage the second flange 128. Alternatively, the bracket 13 may simultaneously engage the third and fourth mounting ribs 116, 126 by sliding the bracket 13 between the respective ribs 116, 126 in a direction generally parallel with the longitudinal axis 71.

After the manifold 64 and the receiver/dryer 62 have been engaged and the deformable ribs have been deformed, the respective components 62, 64 are preferably brazed together in order to form substantially fluid-tight connections. The components may be brazed using a known process, such as a brazing oven. Alternatively, the brazing process is not used, and the mounting ribs 86, 96, 116, 126 form substantially fluid-tight connections between the and the second header 16 are each preferably manifold 64 and the receiver/dryer 62.

It is therefore intended that the foregoing detailed description be regarded as illustrative rather than limiting, and that it be understood that it is the following claims, including all equivalents, that are intended to define the spirit and scope of this invention.

What is claimed is:

1. A condenser assembly for a vehicle air conditioning system, the condenser assembly comprising:

a core including first and second ends and a plurality of tubes extending between the first and second ends, the plurality of tubes having flow passages defined therein;

a first header located adjacent to the first end of the core and being in fluid communication with the flow passages of the tubes; and a second header located adjacent to the second end of the core, the second header including:

a receiver/dryer having a wall defining a receiver/dryer chamber;

a manifold cooperating with the receiver/dryer to define a manifold chamber being in fluid communication with the flow passages in the tubes, the receiver/dryer chamber being in fluid communication with the manifold chamber; and a mounting rib unitarily formed with at least one of the receiver/dryer and the manifold, the mounting rib including a first portion extending away from the at least one of the receiver/dryer and the manifold in a first direction and a second portion extending away from the first portion in a second direction that is substantially nonparallel with the first direction in order to retain together the manifold and the receiver/dryer.

2. A condenser assembly as in claim 1, wherein the first direction and the second direction cooperate to define an angle greater than 45° and less than 135°.

3. A condenser assembly as in claim 2, wherein the first direction and the second direction are generally perpendicular with each other.

4. A condenser assembly as in claim 1, wherein the mounting rib further includes a third portion connecting the first portion and the second portion, wherein the third portion includes a weakened line.

5. A condenser assembly as in claim 4, wherein the weakened line includes an arcuate groove.

6. A condenser assembly as in claim 1, wherein the receiver/dryer includes a top end and a bottom end and the mounting rib extends substantially continuously from the top end to the bottom end in a direction generally perpendicularly to the plurality of tubes.

7. A condenser assembly as in claim 1, wherein the condenser assembly further comprises a second mounting rib unitarily formed with the at least one of the receiver/dryer and the manifold, the second mounting rib including a first portion extending away from the at least one of the receiver/dryer and the manifold in a third direction and a second portion extending away from the first portion in a fourth direction that is substantially nonparallel with the third direction.

8. A condenser assembly as in claim 7, wherein the mounting rib and the second mounting rib are each unitarily formed with the receiver/dryer, wherein the manifold includes a flange and a second flange, and wherein the mounting rib engages the flange of the manifold and the second mounting rib engages the second flange of the manifold.

9. A condenser assembly as in claim 7, wherein the mounting rib is a deformable mounting rib and the second mounting rib is a fixed mounting rib.

10. A condenser assembly as in claim 8, further comprising:

a third mounting rib unitarily formed with the receiver/dryer and including a first portion extending away from the receiver/dryer in a fifth direction and a second portion extending away from the first portion in a sixth direction that is substantially nonparallel with the fifth direction; and a fourth mounting rib unitarily formed with the receiver/dryer and including a first portion extending away from the receiver/dryer in a seventh direction and a second portion extending away from the first portion in an eighth direction that is substantially nonparallel with the seventh direction;

wherein the third mounting rib and the fourth mounting rib engage a mounting bracket coupled to the vehicle.

11. A condenser assembly as in claim 10, wherein the third mounting rib is a deformable mounting rib and the fourth mounting rib is a fixed mounting rib.

12. A condenser assembly as in claim 1, wherein the wall of the receiver/dryer is generally cylindrical-shaped.

* * * * *

UNITED STATES PATENT AND TRADEMARK OFFICE

CERTIFICATE OF CORRECTION

PATENT NO. : 7,007,499 B1
APPLICATION NO. : 10/932865
DATED : March 7, 2006
INVENTOR(S) : Ramchandra L. Patel It is certified that error appears in the above-identified patent and that said Letters Patent is hereby corrected as shown below:

On the Title page

Item [56], References Cited, "U.S. PATENT DOCUMENTS", delete "5,628,206" and substitute --5,628,203-- in its place.

Signed and Sealed this

Fourth Day of July, 2006

JON W. DUDAS
*Director of the United States Patent and Trademark Office*